United States Patent [19]

Wells et al.

[11] Patent Number: 5,074,539

[45] Date of Patent: Dec. 24, 1991

[54] FEEDING SHEETS OF CORRUGATED PAPERBOARD

[75] Inventors: Robert R. Wells, Phoenix, Md.; Boyce C. Dent, Mountville, Pa.

[73] Assignee: Ward Holding Company, Inc., Wilmington, Del.

[21] Appl. No.: 580,847

[22] Filed: Sep. 11, 1990

[51] Int. Cl.[5] ..... B65H 5/08

[52] U.S. Cl. ..... 271/12; 271/99; 271/35

[58] Field of Search ..... 271/6, 11, 12, 34, 35, 271/95, 99

[56] References Cited

U.S. PATENT DOCUMENTS

| | | | |
|---|---|---|---|
| 1,926,306 | 9/1933 | Pettersen . | |
| 2,152,027 | 3/1939 | Carll . | |
| 3,193,282 | 7/1965 | Stewart . | |
| 3,198,514 | 8/1965 | Barbera et al. | 271/12 |
| 3,260,520 | 7/1966 | Sugden | 271/35 |
| 3,279,786 | 10/1966 | Fliegner et al. | 271/35 |
| 3,405,935 | 10/1968 | MacNeil | 271/11 |
| 3,424,453 | 1/1969 | Halbert | 271/35 |
| 3,599,967 | 8/1971 | Rapparlie et al. | 271/12 |
| 3,612,512 | 10/1971 | Lang | 271/35 |
| 3,649,002 | 3/1972 | Burkhardt | 271/12 |
| 3,907,278 | 9/1975 | Jaton | 271/11 |
| 3,941,372 | 3/1976 | Matsuo . | |
| 4,181,298 | 1/1980 | Capdeboscq | 271/6 |
| 4,236,708 | 12/1980 | Matsuo | 271/12 |
| 4,494,745 | 1/1985 | Ward, Sr. et al. . | |
| 4,867,433 | 9/1989 | Wells et al. | 271/35 |
| 4,889,331 | 12/1989 | Sardella | 271/11 |
| 5,006,042 | 4/1991 | Park | 414/795.4 |

FOREIGN PATENT DOCUMENTS

| | | | |
|---|---|---|---|
| 3238 | 1/1981 | Japan | 271/12 |
| 36838 | 3/1983 | Japan | 271/99 |

OTHER PUBLICATIONS

Anderson, T. H. et al., "Document Feeder and Separator", *IBM Technical Disclosure Bulletin*, vol. 6, No. 2, pp. 32-33 (1963).

*Paperboard Packaging*, Oct. 1989, two pages.

*Primary Examiner*—Robert P. Olszewski
*Assistant Examiner*—Steven M. Reiss
*Attorney, Agent, or Firm*—Boyce C. Dent; Edward D. C. Bartlett

[57] ABSTRACT

A lead edge sheet feeder, particularly for corrugated paperboard sheets, has an endless belt transfer section downstream of a control gate. This endless belt is driven at constant speed and at least first and second vacuum boxes are disposed successively along the transfer belt. Both vacuum boxes are continuously connected to a vacuum source. Each vacuum box has an open face which has to be completely covered by the sheet being fed before that vacuum box is effective in drawing the sheet against the transfer belt. There may be a third vacuum box, and vent holes may be provided in a common partition between the third and second vacuum boxes. The feed section, upstream of the control gate, may have modes for long and short sheets, in the shorter sheet mode less length of sheet being contacted by a feed conveyor. Another lead edge feeder has pull rolls as the transfer section in conjuction with a control system for maintaining feeding of each sheet by the feed section until a leading crease line in the sheet has passed downstream of the nip of these pull rolls. Crushing of corrugated sheets is eliminated or reduced by various embodiments.

26 Claims, 6 Drawing Sheets

FEEDING SHEETS OF CORRUGATED PAPERBOARD

FIELD OF THE INVENTION

This invention relates to feeding sheets from a stack to downstream equipment. It particularly relates to feeding sheets of corrugated paperboard and to improving such feeding.

BACKGROUND OF THE INVENTION

In the paperboard industry, it is known to use lead edge sheet feeders for feeding sheets one at a time in timed sequence to downstream equipment, e.g. container blank processing machinery. Such lead edge feeders employ vacuum conveyors as, for example, disclosed in U.S. Pat. No. 4,494,745 and U.S. Pat. No. 4,867,433. These lead edge feeders include a pair of pull rolls for taking over feeding of each sheet from the initial vacuum conveyor and then feeding the sheet to the downstream equipment. Such pull rolls can have an adverse effect on the sheets gripped and fed therebetween.

It has been proposed to replace these pull rolls by a second vacuum conveyor as disclosed in U.S. Pat. Nos. 3,941,372 and 4,236,708 to avoid damage to the sheets by the pressure of the pull rolls, e.g. crushing of corrugated paperboard sheets.

SUMMARY OF THE INVENTION

One aspect of the present invention is concerned with eliminating pull rolls from sheet feeders.

Another aspect of the present invention is additionally, or independently, concerned with providing an arrangement which more gently completes the transfer of the feeding of the sheets to the downstream equipment.

A feature of the present invention to achieve both elimination of pull rolls and this transfer is the incorporation of two vacuum boxes, one downstream of the other, in a transfer section with vacuum being continuously connected to each of these vacuum boxes.

Accordingly, therefore, there is provided by one aspect of the present invention a sheet feeding apparatus comprising a stack support surface for supporting a stack of sheets, a gate adjacent the stack support surface to control one sheet at a time being fed from the stack, sheet feeding means for feeding an end sheet from the stack past the gate in a downstream direction, and transfer conveyor means downstream of the gate for continuing feed of the sheet being fed by the sheet feeding means. The transfer conveyor means comprises an endless transfer belt, means for driving the transfer belt at a constant speed, and at least first and second vacuum boxes disposed successively along the transfer belt for drawing the sheet being fed against the transfer belt; means for continuously connecting each of the vacuum boxes to a vacuum source while the feeding apparatus is feeding sheets; each vacuum box having an open face which has to be completely covered by the sheet being fed before that vacuum box is effective in drawing the sheet against the transfer belt; the first vacuum box being upstream from the second vacuum box with a separating partition therebetween, the first vacuum box being at a location downstream of the gate; and sheet guide means, associated with the first vacuum box and disposed at the downstream location of the first vacuum box, for guiding any sheet if warped towards the first vacuum box.

An open faced third vacuum box may be disposed immediately downstream of the second vacuum box with means for continuously connecting the third vacuum box to a vacuum source while the feeding apparatus is feeding sheets. A partition may be disposed between the third and second vacuum boxes and have vent means therein for venting the third vacuum box to atmosphere through the second vacuum box when a sheet being fed is closing the third vacuum box but has at least partly exposed the open face of the second vacuum box.

The guide means may comprise a plurality of guide plates spaced from the transfer belt to enable unhindered passage of unwarped sheets past these guide plates.

According to another aspect of the invention, there is provided a sheet feeding apparatus comprising a stack support surface for supporting a stack of sheets, intermittently driven feed means for feeding the sheets one at a time from the stack through a control gate in a downstream direction, a feed vacuum box associated with the feed means and having an open face communicating with a sheet while being fed by the feed means. A source of vacuum is continuously connected to the feed vacuum box and is continuously effective, in use, at the open face. Transfer conveyor means, downstream of the control gate, successively receives each sheet from the feed means and then feeds each sheet downstream of the feeding apparatus. The transfer conveyor means comprises a continuously driven endless belt, a first transfer vacuum box having an open face cooperative with an upstream portion of the endless belt, and a second transfer vacuum box having an open face cooperative with a downstream portion of the endless belt. Means separately connects the first and second transfer vacuum boxes continuously, in use, to a supply of vacuum for providing continuous availability of vacuum at the open faces of the first and second transfer vacuum boxes. The upstream portion of the endless belt is only effective to grip the sheet being fed while this sheet is completely covering the open face of the first transfer vacuum box, and the downstream portion of the endless belt only being effective to grip the sheet being fed while this sheet is completely covering the open face of the second transfer vacuum box.

According to yet another aspect of the present invention, there is provided apparatus having a support surface for supporting a stack of sheets, a feed section below the stack for feeding sheets from the bottom of the stack in a downstream direction, and a control gate above the feed section and on a downstream side of the stack for controlling the feeding of the sheets to one at a time. The feed section includes sheet feeding means for contacting and feeding the bottom sheet from the stack, the sheet feeding means being operable in two modes, a first mode for feeding sheets over a predetermined length and a second mode for feeding shorter sheets of a length less than this predetermined length. The sheet feeding means contacts a longer length in the downstream direction of the bottom sheet when in the first mode than when in the second mode. A printing cylinder and a cooperating impression roll form a nip therebetween and are located downstream of the control gate. A transfer section extends between the feed section and the nip for accepting each sheet being fed by the feed section and feeding a leading edge of the accepted sheet through and beyond the nip. This transfer section comprises an endless belt with first and second vacuum boxes, the second vacuum box being downstream of the first vacuum box, and connecting means for separately connecting each of the vacuum boxes continuously to a vacuum source. Each vacuum box has an operative face which is effective to draw the sheet being fed into feeding contact with the endless belt, but only while the respective operative face is closed by the sheet being fed. The sheet being fed is drawn into feeding contact with the endless belt by the second vacuum box but not by the first vacuum box when this sheet has moved downstream to a position in which a trailing edge of this sheet has started to open the operative face of the first vacuum box and vent the first vacuum box to atmosphere.

The invention is generally concerned with improved feeding of and reduced damage to corrugated paperboard sheets. According to another particular aspect, the invention is concerned with reducing any tendency of the sheet being fed to slip relative to pull rolls, when such are employed, particularly when enlarging the clearance between the pull rolls to reduce any crushing effect on the sheets while passing therebetween.

Thus, according to this aspect of the invention, there is provided sheet feeding apparatus comprising a stack support surface for supporting a stack of sheets, at least one sheet feeding member for feeding an end sheet from the stack in a downstream direction, and lift means for moving the sheet feeding member and the stack support surface vertically relative to each other to provide an operative position of said the feeding member and an inoperative position thereof. Transfer means are located downstream of the stack support surface for receiving successive sheets from the sheet feeding member and feeding these sheets further downstream. Control means, capable of having information input thereinto, are provided for controlling operation of the lift means including changing from the operative position to the inoperative position for feeding sheets in dependence upon a linear dimension input into the control means and related to the sheets being fed.

In the case when the transfer means comprises an endless belt vacuum conveyor, the linear dimension can advantageously be the sheet length.

In the case when the transfer means comprises a pair of pull rolls, the linear dimension can advantageously be the lengthwise distance between the leading edge of a sheet and the first crease, or corrugator score, transversely across the sheet; this can provide the advantage of mitigating slippage between the pull rolls and the sheet as this crease or score passes through the nip of the pull rolls.

The control means may include a manually inputable register for inputting the linear dimension, a machine speed transducer responsive to the throughput speed of the downstream machinery, and a signal conditioning unit for producing a servo control signal which is a function of signals produced by the register and the transducer.

Other objects, features and advantages of the present invention will become more fully apparent from the following detailed description of the preferred embodiments, the appended claims and the accompanying drawings.

BRIEF DESCRIPTION OF THE DRAWINGS

In the accompanying drawings, in which like reference characters in the same or different Figures indicate like parts.

DETAILED DESCRIPTION OF THE PREFERRED EMBODIMENTS

Figure 1:
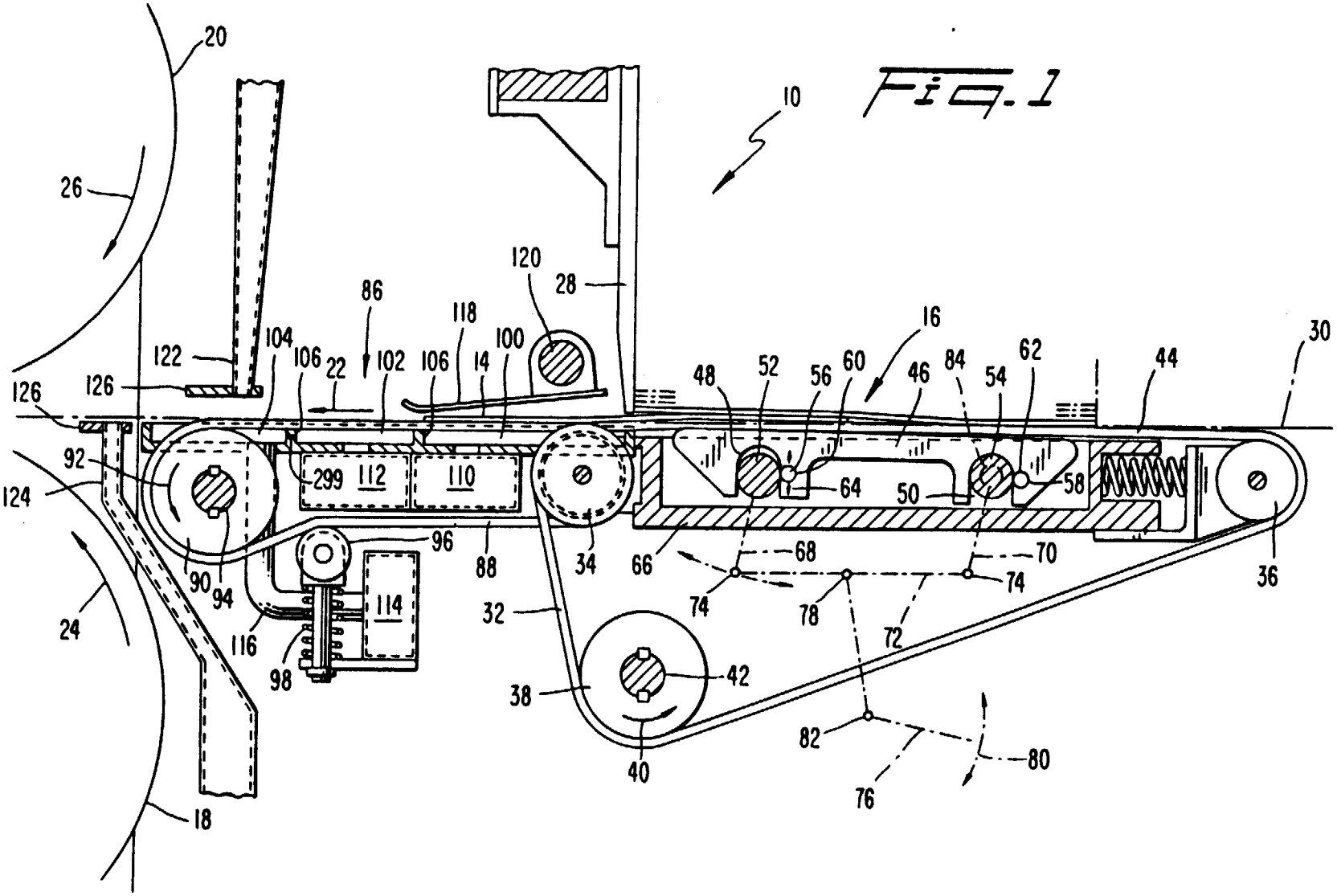
FIG. 1 is a simplified diagrammatic side elevation, partly in section, illustrating a sheet feeding apparatus according to the invention.
Figure 2:
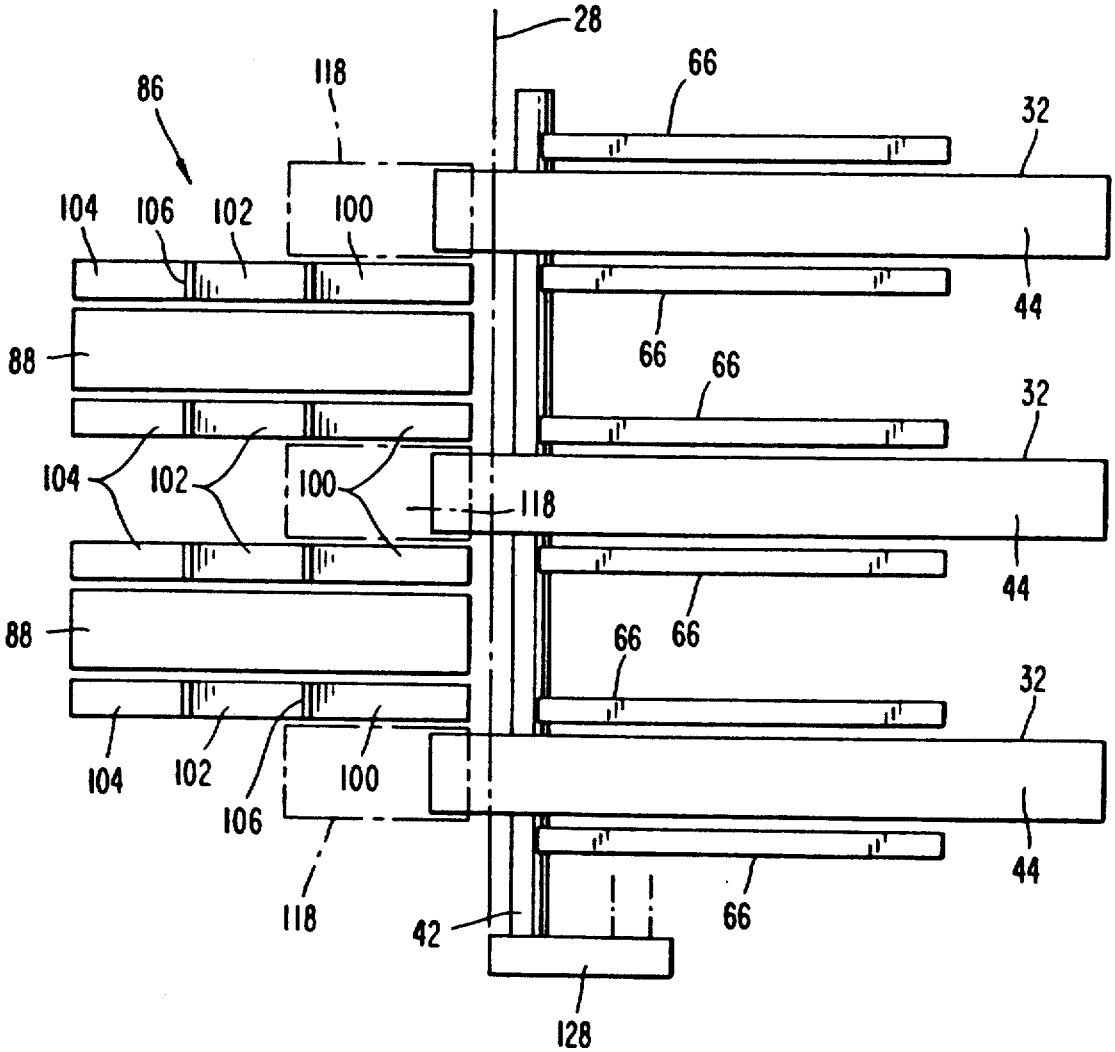
FIG. 2 is a diagrammatic plan view of the sheet feeding apparatus of FIG. 1 with parts omitted for simplicity and clarity.
Figure 3:
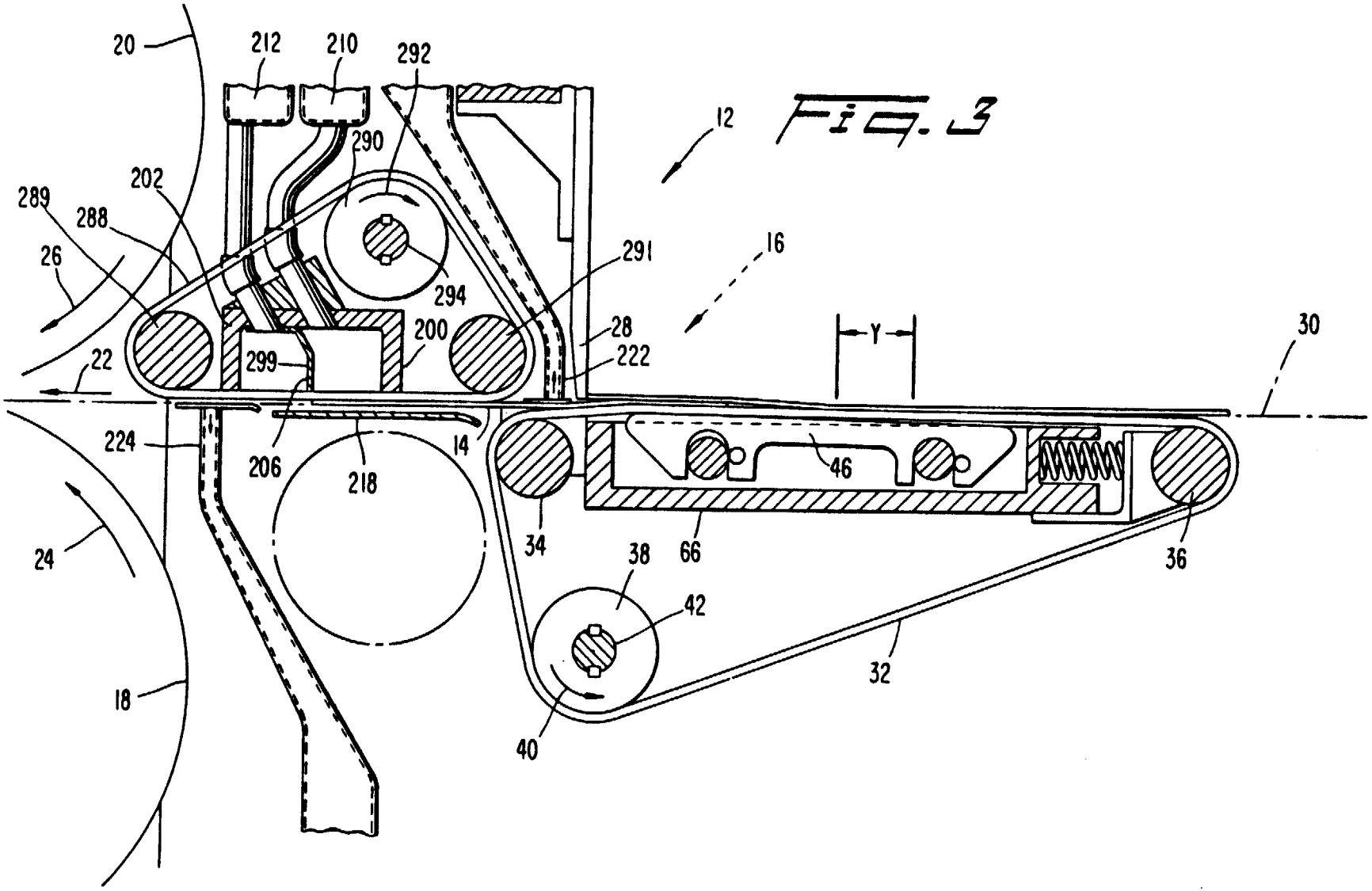
FIG. 3 is a view similar to FIG. 1 but of a second embodiment of a sheet feeding apparatus according to the invention.
Figure 4:
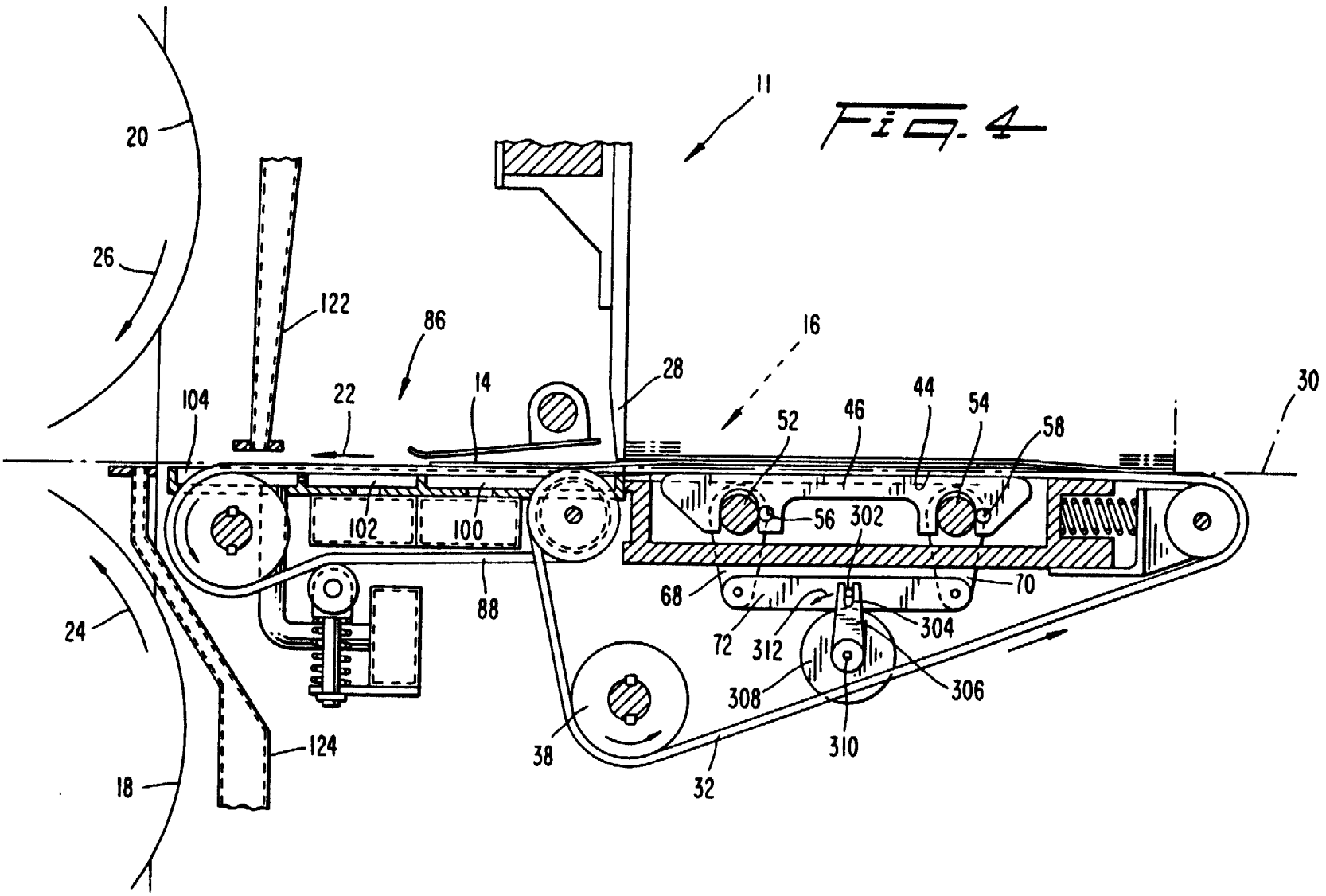
FIG. 4 is a view similar to FIG. 1 of a preferred modification of the sheet feeding apparatus of FIG. 1.

One preferred embodiment of the invention is illustrated in FIGS. 1 and 2 and another in FIG. 3. A further embodiment of the invention is illustrated in FIG. 4 having the preferred feed belt lifting arrangement controlled by the control system of FIG. 5. A fourth embodiment of the invention is illustrated in FIG. 6, this also having the preferred feed belt lifting arrangement and control system of FIGS. 4 and 5. All of these embodiments are lead edge feeders 10, 11, 12, 13 for feeding sheets 14 of corrugated paperboard, one by one from a stack 16 of such sheets, to downstream processing equipment, such as one or more flexographic printing sections, a die cutting section, a slotter section, etc. In FIGS. 1 3, 4 and 5, container blanks 14 are illustrated being fed in the direction of the arrow 22 to and through the kissing nip of a printing cylinder 18 and a cooperating impression roll 20 which are rotatably driven in the direction of the arrows 24, 26 respectively. An adjustable vertical gate 28 allows only one sheet at a time to be fed from the bottom of the stack 16.

FIG. 1 illustrates the stack 16 supported on a horizontal support surface 30. A plurality of parallel, endless feed belts 32 (see also FIG. 2) spaced apart across the width of the feeder are each trained over front and rear idler pulleys 34, 36 and a lower drive pulley 38. The drive pulleys 38 are intermittently rotatably driven in the direction of the arrow 40 by a drive shaft 42 on which they are keyed in axial spaced-apart relationship. The upper flight 44 of each feed belt 32 passes over a bar 46 disposed between each pair of pulleys 34, 36. Each bar 46 has forward and rear downwardly open slots 48, 50 which slidably engage over oscillatable shafts 52, 54, respectively. Each shaft has a circular section key 56, 58 secured axially along one side thereof, these keys 56, 58 rotatably engaging in correspondingly shaped seats 60, 62 in the rear walls of the slots 48, 50. Rotation, or more accurately oscillation, of the shafts 52, 54 about their central axes causes the keys 56, 58 to move arcuately up and down, as indicated by the arrows 64 at key 56, so causing each bar 46 to be raised slightly above the support surface 30 or withdrawn a little below this support surface 30. When the bars 46 are in the raised position, the upper flights 44 of the belts 32 frictionally engage the lowermost blank 14 in the stack 16 and feed this blank 14 forwardly below the gate 28. When the bars 46 are in their lower position, spaced below the surface 30, the belts 32 do not engage the lowermost blank 14 (or any blank already in the process of being fed to the print cylinder 24). The shaft 42 is accelerated from rest, driven at a constant speed, and then decelerated to rest in timed relation to the raising and lowering of the bars 46; the raised position of the bars 46 providing an operative position of the feed belts 32, and the lowered position of the bars 46 providing an inoperative position of the feed belts 32. In this way, the lowermost blank in the stack 16 can be engaged by the friction surfaced belts 32 while stationary, so that the upper flights 44 engage this blank with static friction therebetween. The belts 32 then accelerate this blank from rest to line speed, i.e. the surface speed of the printing cylinder 18 and the impression roll 20. The belts 32 can then be lowered out of contact with the blank being fed and decelerated to rest, the upper flight 44 of each belt remaining for a period at rest below the support surface 30. In this way each bottom sheet of the stack 16 can be successively fed under the gate 28 in timed relation to the downstream processing machinery, e.g. to register with the printing die of the printing cylinder 18.

An upwardly open vacuum box 66 extends along each side of each upper flight 44, the upper edges of the boxes 66 forming part of the support surface 30. These vacuum boxes are connected to a common plenum extending across the sheet feeder 10 below the support surface 30, this common plenum being connected to a source of continuous vacuum so that vacuum is continuously applied at the upper edges of the vacuum boxes 66 to draw the lowermost blank of the stack 16 downwards thereagainst or towards. This continuous application of vacuum serves to flatten warped sheets and hold the sheet 14 being fed tightly against the upper flights 44 of the feed belts 32.

The general construction and operation of the feed belts 32, the raising and lowering of the lift bars 46, the transmission for intermittently driving the shaft 42, the application of vacuum, and the timing of these movements is described and illustrated in greater detail in U.S. Pat. No. 4,494,745, the disclosure of which is hereby incorporated herein by reference. This mechanism and its operation in feeding different length sheets is further described and modified in U.S. Pat. No. 4,867,433, the disclosure of which is also hereby incorporated herein by reference.

However, according to the present invention, the drive to the lift shaft 54 may be disconnected and only the forward portion of each lift bar 46 raised and lowered by the oscillation of the forward lift shaft 52, the bars 46 then pivoting on the disconnected rear lift shaft 54 which, due to the key 58, pivots in unison with the bars 46. A radial arm (or a gear segment) 68, 70 is secured to each lift shaft 53, 54. A cross link (or a gear segment) 72 pivotally connects the lower ends 74 of the arms 68, 70. A bell crank lever 76 has one end pivotally attached at 78 to the cross link 72 and the other end oscillatable in the direction of the arrow 80 via a rotating cam or other suitable mechanism, the bell crank lever being pivotally mounted at 82. The arm 68 is rigidly connected to the lift shaft 52, but the arm 70 is connected to the rear lift shaft 54 via a disengageable coupling 84. The coupling 84 can be engaged or disengaged via a solenoid to cause the arm 70 to drivingly oscillate the shaft 54 or pivot relative to the shaft 54. For feeding long sheets, the coupling 84 is connected so that the whole of each bar 46 raises and lowers relative to the support surface 30 with the bar remaining parallel thereto. For feeding short sheets, as illustrated, the coupling 84 is disconnected so that each bar 46 pivots on rear shaft 54 with only the forward portion of each lift bar 46 raising above the support surface 30; this minimizes the feeding flights 44 of the belts 32 interfering with the next bottom sheet of the stack 16 while still feeding the bottom sheet 14.

Between the gate 28 and the printing cylinder 18 is a transfer conveyor 86 comprising a plurality of parallel endless belts 88 (see also FIG. 2) each trained over a forward driven pulley 90 and a rear idler pulley 34. The upper flight of each transfer belt 88 is in the plane of the support surface 30 with the rest of the transfer conveyor 86 being below. The forward pulleys 90 are continuously driven in the direction of the arrow 92 by a drive shaft 94 to continuously drive the belts 88 at the line speed of the downstream machinery. The rear idler pulleys 34 are the same as, coaxial with, but interdisposed between the forward idler pulleys 34 of the feed belts 32. A tensioning pulley 96 is biased upwardly by a spring 98 against the lower flight of each transfer belt 88. Three adjacent vacuum boxes 100, 102, 104 together extend along each side of the upper flight of each transfer belt 88 (see also FIG. 2). The abutting vacuum boxes are separated by vertical partitions 106. Each vacuum box 100, 102, 104 is connected via a port to a separate vacuum plenum 110, 112, 114. All first vacuum boxes 100 being connected to the same plenum 110 which extends transversely across the transfer conveyor 86 between the upper and lower flights of the transfer belts 88. All the second vacuum boxes are similarly connected to the single plenum 112 likewise extending transversely across the transfer conveyor alongside the plenum 110. All the third vacuum boxes 104 are connected by short pipes 116 to the single plenum 114 disposed below the lower flight of the transfer belts 88 directly below the plenum 112. Each plenum 110, 112, 114 is preferably connected to a separate source of vacuum, but two or all three of these plenums could be separately connected to the same source of vacuum.

A sheet 114 being fed from the bottom of the stack 16, progressively passes over the row of first vacuum boxes 100, then the row of second vacuum boxes 102, and then the row of third vacuum boxes 104. Vacuum is continuously connected to all the vacuum boxes 100, 102, 104 to draw each advancing sheet 14 firmly against, and into driven frictional contact with, the continuously driven transfer belts 88 which are always being driven at the machine speed of the downstream machinery. However, as the tops of the vacuum boxes 100, 102, 104 are open to atmosphere, any of these vacuum boxes is not effective to draw a sheet 14 against the belts 88 until that vacuum box is completely covered by the advancing sheet 14. That is, until any particular vacuum box is fully covered by the advancing sheet, atmospheric air is drawn into the vacuum box by the source of vacuum connected thereto, so applying insufficient reduced air pressure to the underside of the advancing sheet to draw it firmly towards the vacuum box and against the belts 88.

Thus, as the leading edge of an advancing sheet 14 passes under the gate 28 and over the first vacuum boxes 100, this sheet is not drawn into firm frictional engagement with the moving belts 88 until the sheet's leading edge reaches the partitions 106 between the first and second boxes 100, 102 and so closes the top of each first vacuum box 100. Similarly, the second vacuum boxes 102 have no effect until the leading edge of the advancing sheet reaches the partitions 106 between the second and third vacuum boxes 102, 104. The third vacuum boxes 104 are similarly effective in drawing the advancing sheet 14 against the transfer belts 14 only after the leading edge of the sheet 14 has reached the downstream end of the boxes 104 to completely cover the tops of the boxes 104.

An adjustable board guide 118 is disposed above the level of the upper flight of the transfer belts 88 and is mounted on an adjustable shaft 120 just downstream from the gate 28. Adjustable rotation of the shaft 120 through a few degrees spaces the guide 118 from and above the plane of the support surface 30 a distance depending upon the thickness of the sheets being processed. The guide is adjusted so that it normally will not touch an advancing sheet 14 other than to force down a warped leading edge so that the vacuum can be effective to pull the warped sheet down against the transfer belts 88. The guide 18 forms a downwardly inclined ramp for such warped sheets and extends the full length of the first vacuum box 100.

An upperside dust cleaning nozzle 122 is disposed just a short distance above the plane of the advancing sheets 14 at a location over the third vacuum box 104. A lowerside dust cleaning nozzle 124 is disposed directly below the plane of the advancing sheets 14 at a location between the downstream end of the third vacuum box 104 and the nip of the printing cylinder 18 with the impression roll 20. Both cleaning nozzles 122, 124 extend across the width of the transfer conveyor 86 and are connected to a source of vacuum. Each cleaning nozzle 122, 124 at its mouth has a plate-like foot 126 which extends in a plane parallel to, and in closed proximity to, each sheet 14 as it advances to the printing cylinder 18 to clean dust etc. from both sides of the advancing sheet.

FIG. 2 is a simplified plan view of the sheet feeder of FIG. 1. The transfer belts 88 can be seen interdisposed between the feed belts 32. The series of three vacuum boxes 100, 102, 103 can be seen alongside each transfer belt 88. The position of the gate 28 is shown by a broken line with the belts 88 completely downstream from the gate 28, but with the delivery ends of the feed belts 32 extending a short distance past and downstream of the gate 28. The board guide 118 is shown in broken lines as made up of three guide plates spaced to the sides of and between the transfer belts 88 and their associated vacuum boxes 100, 102, 104. The drive shaft 42 for the feed belts 32 is shown extending across the full width of the sheet feeder and connected at one end to an intermittent drive transmission 128. The transmission 128 accelerates the feed belts 32 from rest, operates them at a predetermined feed speed, and then decelerates them back to rest in a cycle for each sheet 14 fed from the stack 16.

Operation of the sheet feeder for long sheets will now be described. Long sheets are those greater than say 15 inches in the machine feed direction (note, short sheets are illustrated in FIG. 1). A pile of long sheets is placed in the stack 16 and the coupling 84 engaged for drivingly oscillating the rear lifter shaft 54. At the beginning of feed, the feed belts 32 are stationary but with their upper flights 44 raised into contact with the bottom sheet by the lift bars 46 being in their fully raised position with both ends raised by keys 56, 58. The feed belts 32 then accelerate to machine speed carrying the bottom sheet 14 with them. This sheet reaches machine speed when its leading edge reaches the downstream end of the first vacuum boxes 100 of the transfer conveyor 86. As previously mentioned, the vacuum in any first box 100 has no effect on this sheet 14 until the sheet closes the vacuum box 100 because the box is vented to atmosphere in front of the sheet. When the vacuum box is closed by the sheet, coupling of the sheet to the transfer belts 88 occurs, and at this point the fed sheet is travelling at the same speed as the transfer belts 88. The feed belts 32 still continue at machine speed and remain vacuum coupled via vacuum boxes 66 to the sheet. Thus, the sheet is now under feed control of both sets of belts 32 and 88 which at this point are moving at the same speed; this continues until the second vacuum boxes 102 are closed off as the leading edge of the sheet reaches the downstream end of the second vacuum boxes 102. At this point, the lift bars 146 descend, the feed belts 32 are withdrawn from the sheet being fed, and the feed belts 32 begin decelerating to zero velocity preparatory to advancing the next sheet in the stack. At this point, the sheet 14 being fed covers, and is vacuum coupled by, both the first and second vacuum boxes 100 and 102—this providing about the same area of vacuum coupling as previously provided by the vacuum boxes 66 in the feed section. This situation continues until the sheet closes off the third vacuum boxes 104 at which time the sheet 14 is under the control of all three sets of vacuum boxes 100, 102 and 104. The sheet continues to be fed by the transfer belts 88 until it reaches the print cylinder 18/impression roll 20 and beyond, depending upon the length of the sheet. This sheet is uncoupled from the three vacuum boxes 100, 102, 104 in sequence as the trailing edge of the sheet passes downstream of the upstream end of the respective vacuum box so venting that box to atmosphere. As will be appreciated, this enables each sheet to be positively fed to a point beyond the nip of the print cylinder and impression roll—which is a "kiss" type contact with the sheet, and then a gradual and progressive change-over provided from sheet feed by the transfer conveyor 86 to sheet feed by the downstream machinery.

Operation of the sheet feeder for short sheets, say less than 15 inches, will now be described. The sheets illustrated in FIG. 1 are about 12 inches in sheet length in the direction of the arrow 22. Feeding of short sheets is similar to the above feeding of long sheets except for a few differences which will be described. The belt lift bars 46 are lowered when the leading edge of the sheet 14 being fed closes off the first transfer vacuum boxes 100, although the feed belts 32 continue at machine speed &:o the same point as for long sheets above. This is done to prevent the feed belts 32 from trying to feed the next sheet in the stack 16 (which could jam such next sheet into the gate 28) as the bottom sheet, in the process of being fed, clears the stack 16. The second cam of a two cam arrangement, similar to that in the dual feed cam arrangement disclosed and shown in the above referenced U.S. Pat. No. 4,867,433, is employed to drop the lift bars 46 at this earlier point for short sheets. Thus, the sheet 14 is controlled by the feed belts 32 and the transfer belts 88 over the first vacuum box 100, both sets of belts running at machine speed. However, as the sheet 14 advances over the second vacuum box 102, the feed belts 32 no longer engage the sheet.

Even though each first vacuum box 100 is not as long as the boxes 66 in the feed section, there is less drag on the sheet being fed when it is a short sheet. Additional force is exerted on the sheet 14 when the second vacuum boxes 102 are closed by the leading edge of the sheet 14. Still additional force is exerted when the third vacuum boxes 104 are closed, but just thereafter the trailing edge of the sheet 14 vents the first vacuum boxes 100 to atmosphere. By the time the trailing edge vents the third vacuum boxes 104 to atmosphere, the leading edge of the sheet has passed through the nip of the print cylinder/impression roll and is under the control thereof. As mentioned previously, the feed belt lift bars 46 are pivoted about the upstream lift shaft 54 for short sheet feeding, the coupling 84 being disengaged to effect this. This is done so that the full length of the lift bar 46 does not effect feed belt engagement with the next sheet too soon, as it might if the full length of the lift bar 46 was active. Tests have indicated that less than full length lift bar engagement by the feed belts 32 is sufficient for the feeding of short sheets.

FIG. 3 illustrates a second embodiment which is essentially the same as the embodiment of FIGS. 1 and 2, except the transfer conveyor is arranged to contact and feed the upper surface of each sheet, and the number of successive vacuum boxes in the transfer conveyor has been reduced from three to two. Only the differences between the two embodiments will be described. A plurality of transfer belts 288 are disposed side-by-side similarly to the transfer belts 88 in FIG. 2, but above the plane of the support surface 30 with the lower flight of each transfer belt 288 in the plane of sheet feeding. Each belt 288 is trained around forward and rear idler pulleys 289 and 291, and an upper drive pulley 290, all the drive pulleys being mounted on a common drive shaft 294 rotated in the direction of the arrow 292. The first and second transfer vacuum boxes are referenced 200 and 202, respectively, and their separate plenums (connected to separate vacuum sources) are referenced 210 and 212, respectively. The pairs of vacuum boxes 200, 202 are separated by a thin partition 206. On the opposite side of the sheet feed plane to the transfer belts 288 is a board guide 218. The guide 218 is generally parallel to the sheet feed plane with an outwardly flared entrance end, and is adjustably spaced a short distance below the belts 288 to normally not contact sheets 14 being fed but to guide any warped sheets for gripping by the vacuum of vacuum boxes 200, 202. The upper surface dust cleaning nozzle 222 is disposed between the gate 28 and the rear idler pulley 291. Whereas the lower surface dust cleaning nozzle 224 is disposed below the forward idler pulley 289 immediately downstream of the board guide 218. The cleaning nozzles 222 and 224 are otherwise similarly constructed and operated as the nozzles 122 and 124 of FIG. 1.

The operation of this FIG. 3 embodiment with both long sheets and short sheets is similar to that described above for the embodiment of FIGS. 1 and 2, except a third transfer vacuum box is not used.

When feeding short sheets as shown in FIG. 3, there may be a short section Y of the next bottom sheet in the stack 16 that is engaged by the raised and driving feed belts 32 before the lift bars 46 descend, this occurring while a trailing section of the short sheet 14 being fed is passing under the gate 28. This section Y may be about two inches long. Such a section Y may also occur with the embodiment of FIG. 1.

FIG. 4 illustrates a third embodiment which is exactly the same as the first embodiment of FIGS. 1 and 2, except for the mechanism for and manner of lifting the feed belt lift bars 46. The plurality of side-by-side lift bars 46 are the same, as are the oscillatable shafts 52, 54 with attached arms 68, 70 pivotally connected at their lower, free ends to cross link 72. However, the disengageable coupling 84 of FIG. 1 is omitted, and the arm 70 is rigidly attached to the shaft 54—as is the arm 68 to the shaft 52. The cross link 72 has, midway along its length, a transversely projecting pin 302 which extends horizontally at right angles to the link 72. This pin 302 slidably engages in a radial slot 302 in the free end of a pivotally oscillatable drive arm 306. A servo motor 308 drivable oscillates the arm 306 in a timed sequence determined by the control system shown in FIG. 5. Arcuate oscillation of the arm 306 by the servo motor drive shaft 310 effects longitudinal oscillation of the link 72; this effects simultaneous oscillation of the arms 68, 70 in parallel, which is turn causes simultaneous equal oscillation of the two shafts 52, 54 to lower and raise the bars 46 via the transverse keys 56, 58. During this movement, the bars 46 all remain horizontal. In FIG. 4, the bar 46 is shown in its raised position elevating the upper flight 44 of one of the belts 32 above the support surface 30 of the stack 16. Pivotal movement of the drive arm 306 counterclockwise in the direction of the arrow 312 lowers each lift bar 46 to drop the upper flights 44 below the support surface 30. Completion of pivotal oscillation of the drive arm 306 clockwise again raises the lift bars 46 and upper flights 44.

Figure 5:
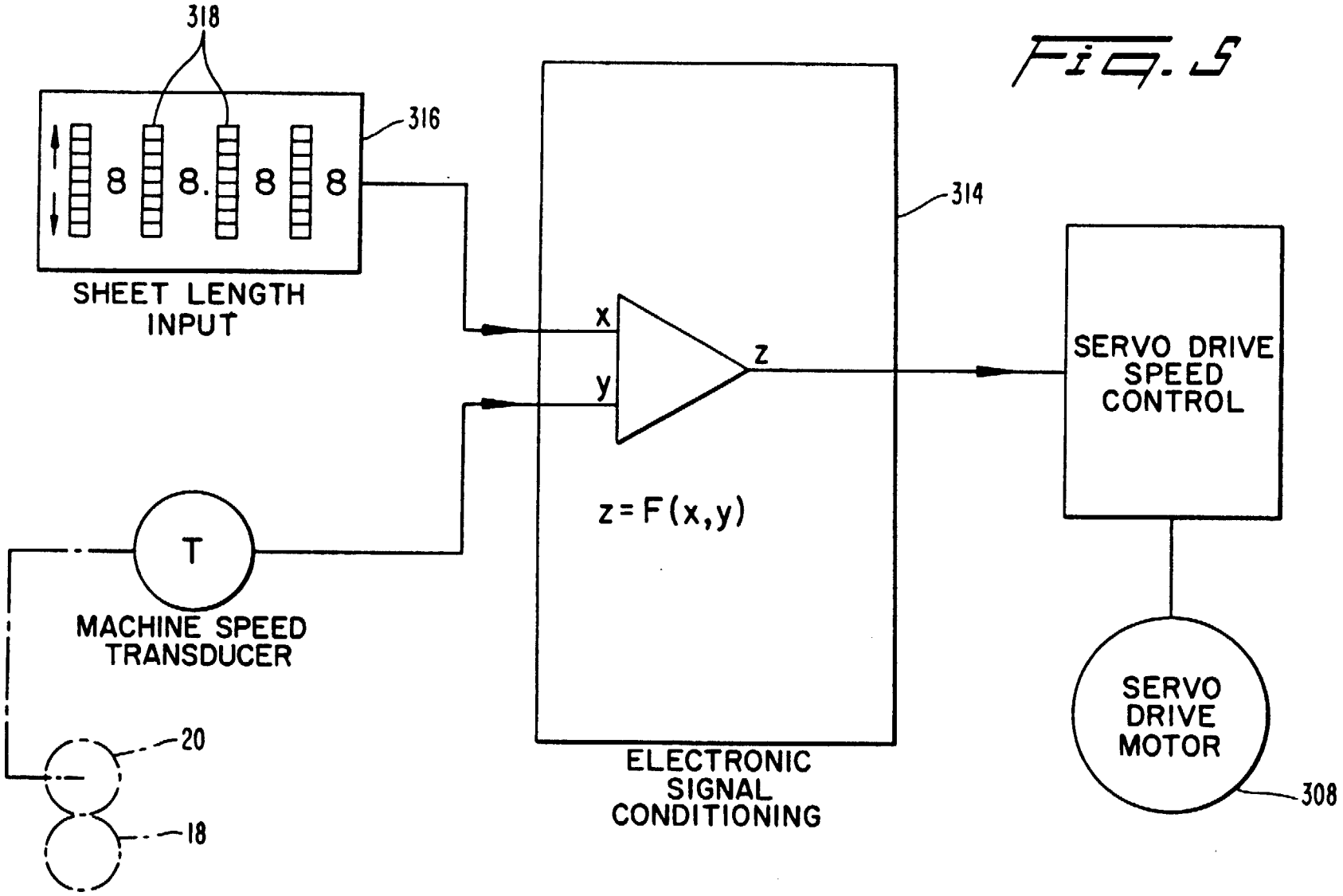
FIG. 5 is a schematic of a control system according to the invention for lifting the feeding belts in the embodiments of FIGS. 4 and 6.
Figure 6:
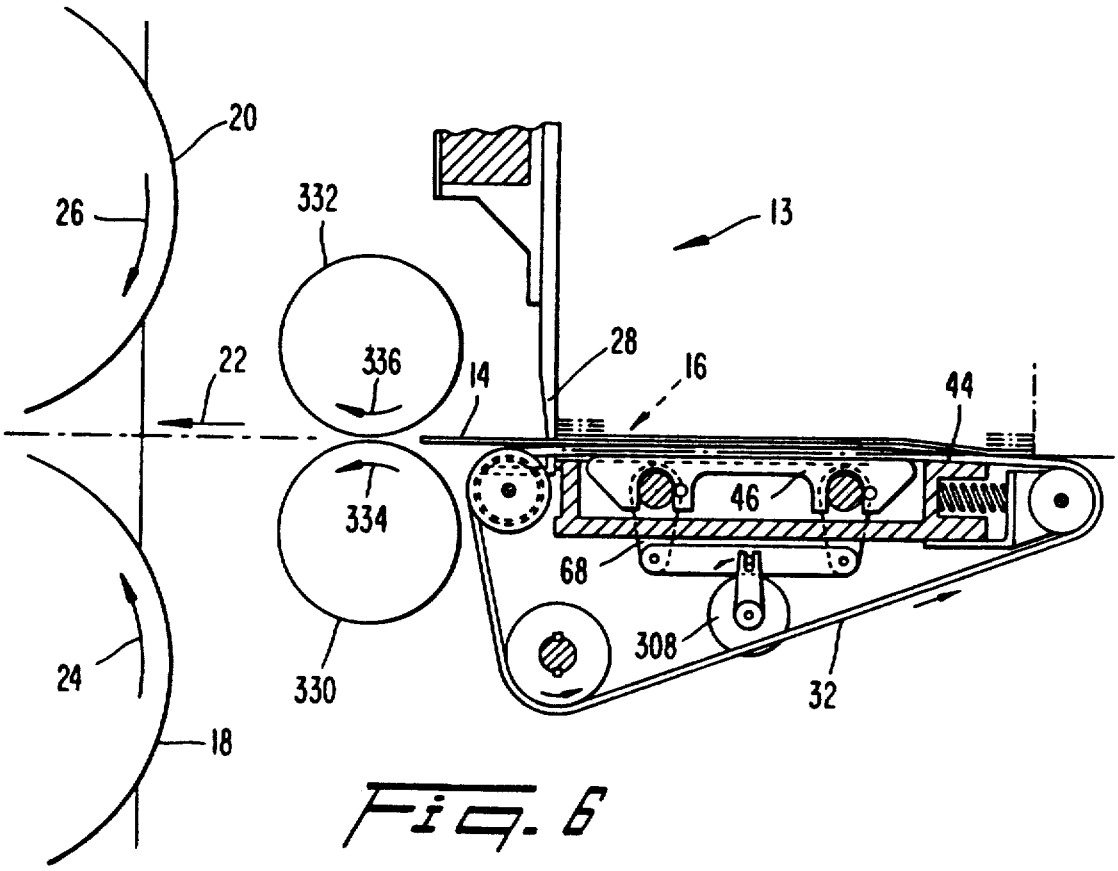
FIG. 6 is a view similar to FIG. 1 of a further embodiment according to the invention which utilizes the control system of FIG. 5.

FIG. 5 shows schematically the control system for oscillating the drive shaft 310 of the servo motor 308. The machine speed of the downstream machinery, e.g. the speed of rotation of the print cylinder 18 and impression roll 30, is transmitted via a transducer T as an input signal y to an electronic signal conditioning unit 314. A register 316 has four rotatable thumb wheels 318 for inputting the length of the sheets being fed. This sheet length dialled into the register 316 produces another input signal x to the signal conditioning unit 314. The signal conditioning unit 314 produces an output signal z which is fed to a servo drive speed control unit 320 which in turn controls oscillation of the servo drive motor 308 to lower and raise the lift bars 46. The signal z is a function of the signals x and y. The servo motor 308 is biased to oscillate in a counterclockwise direction (in FIG. 4) through a fixed arc to lower the lift bars 46 and maintain them in their lowered position with the feed belts 32 inoperative to feed the lowermost sheet of the stack 16. The signal conditioning unit 314 tells the servo motor 308 to oscillate in a clockwise direction through a fixed length arcuate stroke to raise the lift bars from their lowered position to their upper position shown in FIG. 4; the duration of the signal corresponds to the sheet length dialled into register 316. As the leading edge of the sheet 14 being fed nears the end of the third vacuum box 104, the signal z is removed and the servo motor 308 reverses direction to lower the lift bars 46, the drive arm oscillating in the direction of the arrow 312 in FIG. 4. The signal y from the machine speed transducer T ensures that the timing of the oscillation strokes of the servo motor 308 matches changes in machine speed. With the arrangement of FIG. 4, the lift bars 46 remain horizontal as they ascend and descend.

Thus, it will be appreciated that the mechanism can be controlled so that the lift bars 46 lower when the leading edge of the sheet 14 has just covered the most downstream vacuum box, the three vacuum boxes 100, 102 and 104 then being in full control of the sheet 14. This should provide a smooth handoff between the feed belts 32 and the transfer belts 88. By lowering the lift bars 46 when the leading edge of the sheet 14 covers the third vacuum box 104, there is less opportunity for the feed belts 32 to begin acting on the next sheet.

The control system of FIG. 5 could also be used with the embodiments of FIGS. 1 and 3.

In the above embodiments, the last transfer vacuum box may be vented to the preceding vacuum box by small vent holes 299 in the partition between these vacuum boxes; for example, in FIG. 1 the partition 106 between the third and second vacuum boxes 104 and 102 may be provided with small vent holes 299. This would cause a slow bleed-down of the vacuum in the last downstream vacuum box as the immediately preceding vacuum box is uncovered by the trailing end of the sheet being fed and so vented to atmosphere. In this way, an even more gentler handoff of this sheet to the print cylinder/impression roll would be obtained.

FIG. 6 illustrates a fourth embodiment similar to the embodiment of FIG. 4, and employing the control system of FIG. 5, but with the transfer vacuum conveyor 86 replaced by a pair of pull rolls 330, 332 rotating in the direction of the arrows 334, 336 at the same peripheral surface speed as the print cylinder 18 and impression roll 20. This embodiment particularly solves a problem that has been noticed when feeding creased corrugated paperboard container blanks from a stack using pull rolls as the transfer means immediately downstream of the stack gate 28.

Figure 7:
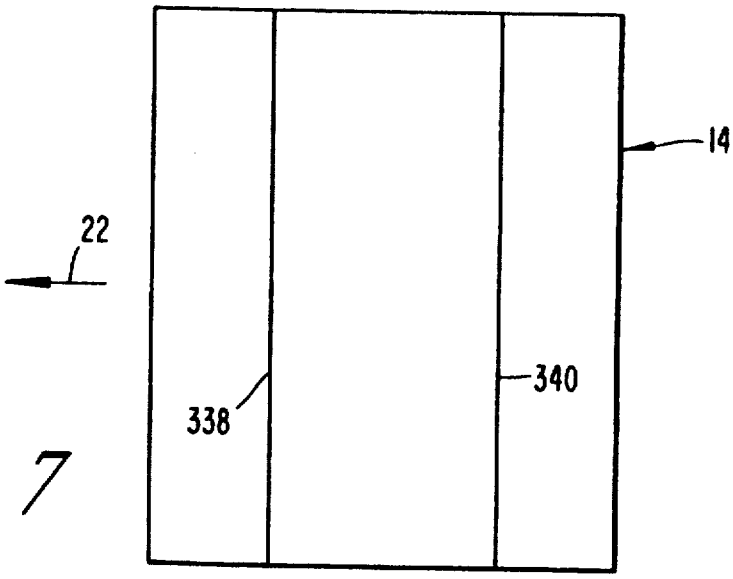
FIG. 7 is a plan view of a corrugated paperboard container blank having score lines.

FIG. 7 is a plan view of the corrugated paperboard sheet 14 showing a leading crease or score line 338 and a parallel trailing crease line 340. There may be one or more additional crease lines between the creases 338, 340. The sheet is fed in the direction of the arrow 22, and the creases 338, 340 are at right angles to the feed direction 22. It has been noticed, that if the pull rolls 330, 332 completely take over the feeding of the sheet 14 as soon as the leading edge of this sheet enters the nip of the pull rolls 330, 332—with the upper flights 44 of the feed belts 32 at that point descending and becoming inoperative, then slippage tends to occur between the pull rolls and the sheet 14 when the leading crease 338 is in the nip of the pull rolls 330, 332. In other words, it has been noticed that although the pull rolls can grip the leading portion of the sheet 14 and feed the sheet towards the print cylinder 18 in register and in timed relation thereto, as soon as the leading crease line 338 enters the nip of the pull rolls some slippage occurs between the pull rolls and the sheet; this tends to result in the sheet 14 losing exact register with the print cylinder 18 before the sheet 14 passes into the nip between the print cylinder 18 and the impression roll 20.

In the embodiment of FIG. 6, the control system of FIG. 5 is programmed so that the feed belts 32 continue to vacuum grip and positively feed the sheet 14, until the leading portion of the sheet 14, upto and at least slightly beyond the leading crease line 338, has passed through the nip of the pull rolls 330, 332. In other words, the upper flights 44 remain raised and do not lower to their inoperative retracted position until after the leading crease line 338 has passed through and downstream of the nip of the pull rolls 330, 332. In this embodiment, the length of the leading portion of the sheets from the leading edge to the leading crease line 338 is inputted into the register 316 via the thumb wheels 318 to generate an appropriate signal x for the required operation of the servo drive motor 308.

With the embodiment of FIG. 6, the nip between the pull rolls 330, 332 can be slightly enlarged, i.e. the gap between the rolls can be increased, as the leading crease line passes beyond this nip while still positively fed by the feed belts 32, thus reducing the crushing effect of these pull rolls on corrugated paperboard sheets. This nip could be even further enlarged, to virtually kiss contact, by extending positive feed by the raised upper flights 44 until the leading edge of the sheet 14 passes beyond the nip of the print cylinder 18 and impression roll 20.

The above described embodiments, of course, are not to be construed as limiting the breadth of the present invention. Modifications, and other alternative constructions, will be apparent which are within the spirit and scope of the invention as defined in the appended claims.

For example, in all the foregoing embodiments, the cross links or segments 72 and their drive arrangements may be omitted and replaced by a servo motor on, or directly driving, each of the shafts 52, 54. The two servo motors would be the same as the servo motor 308 and both would be simultaneously controlled by the control system of FIG. 5.

Also, the disconnectable coupling 84 of the FIG. 1 embodiment could be incorporated on shaft 54 in the FIG. 4 and FIG. 6 embodiments to optionally enable only the downstream portions of the lift bars 46 to be raised.

Further, the embodiment of FIG. 3 could have three vacuum boxes above the operative flight of the transfer belts 288 just as the embodiment of FIG. 4 has three vacuum boxes below the operative transfer flights.

It will be appreciated that the above embodiments provide lead edge feeders with improved feeding of corrugated paperboard sheets, either eliminating any tendency for crushing of such sheets, or at least enabling such tendency for crushing to be reduced, and/or reducing any possibility of slippage while feeding the sheets.

What is claimed is:

1. A sheet feeding apparatus, comprising:

a stack support surface for supporting a stack of sheets a gate adjacent the stack support surface to control one sheet at a time being fed from the stack;

a plurality of sheet feeding members for feeding an end sheet from the stack past the gate in a downstream direction;

transfer conveyor means downstream of the gate for continuing feed of the sheet being fed by the sheet feeding members;

said transfer conveyor means comprising an endless transfer belt, means for driving said transfer belt at a constant speed, and at least first and second vacuum boxes disposed successively along the transfer belt for drawing the sheet being fed against the transfer belt;

means for maintaining each of said vacuum boxes in continuous communication with a supply of vacuum, while the feeding apparatus is feeding sheets, to provide continuous availability of vacuum at each of said vacuum boxes;

each vacuum box having an open face which has to be completely covered by the sheet being fed before the continuous availability of vacuum at that vacuum box is effective in drawing the sheet against the transfer belt; and said first vacuum box being upstream from said second vacuum box with a separating partition therebetween, the first vacuum box being at a location downstream of said gate.

2. The apparatus of claim 1, further comprising sheet guide means, associated with the first vacuum box and disposed at the downstream location of the first vacuum box, for guiding any sheet if warped towards the first vacuum box.

3. The apparatus of claim 2, wherein said guide means comprises a plurality of guide plates spaced from the transfer belt to enable unhindered passage of unwarped sheets past said guide plates.

4. The apparatus of claim 1, further comprising an upper cleaning nozzle and a lower cleaning nozzle for sucking dust from opposite sides of the sheet being fed, one of the cleaning nozzles being adjacent a downstream end of said transfer belt, and the other of the cleaning nozzles being spaced upstream from said one.

5. The apparatus of claim 4, wherein each of said cleaning nozzles terminates in a foot plate, each foot plate being adjacent and extending parallel to a plane in which the sheet being fed is fed by said transfer belt.

6. The apparatus of claim 1, wherein said sheet feeding members comprise a plurality of parallel, spaced apart, endless feed belts with associated feed vacuum boxes therebetween, lift bars associated with said feed belts, and means for raising and lowering said lift bars to move flights of said feed belts into and out of contact with the end sheet of said stack and for keeping said flights in contact with the sheet being fed until that sheet reaches the downstream end of at least the first vacuum box.

7. A sheet feeding apparatus, comprising:

a stack support surface for supporting a stack of sheets;

a gate adjacent the stack support surface to control one sheet at a time being fed from the stack;

a plurality of sheet feeding members for feeding an end sheet from the stack past the gate in a downstream direction;

transfer conveyor means downstream of the gate for continuing feed of the sheet being fed by the sheet feeding members;

said transfer conveyor means comprising an endless transfer belt, means for driving said transfer belt at a constant speed, and at least first and second vacuum boxes disposed successively along the transfer belt for drawing the sheet being fed against the transfer belt;

means for continuously connecting each of said vacuum boxes to a vacuum source while the feeding apparatus is feeding sheets;

each vacuum box having an open face which has to be completely covered by the sheet being fed before that vacuum box is effective in drawing the sheet against the transfer belt;

said first vacuum box being upstream from said second vacuum box with a separating partition therebetween, the first vacuum box being at a location downstream of said gate;

an open faced third vacuum box disposed immediately downstream of the second vacuum box and separated therefrom by a partition; and means for continuously connecting the third vacuum box to a vacuum source while the feeding apparatus is feeding sheets.

8. The apparatus of claim 7, wherein the partition between the third and second vacuum boxes has bent means therein for venting the third vacuum box to atmosphere through the second vacuum box when a sheet being fed is closing the third vacuum box but has at least partly exposed the open face of the second vacuum box.

9. A sheet feeding apparatus, comprising:

a stack support surface for supporting a stack of sheets;

intermittently driven feed means for feeding the sheets one at a time from the stack through a control gate in a downstream direction;

a feed vacuum box associated with said feed means and having an open face communicating with a sheet while being fed by said feed means;

a source of vacuum continuously connected to said feed vacuum box and continuously effective, in use, at said open face;

transfer conveyor means, downstream of said control gate, for successively receiving each sheet from the feed means and then feeding each sheet downstream of the feeding apparatus; and said transfer conveyor means comprising:

a continuously driven endless belt;

a first transfer vacuum box having an open face cooperative with an upstream portion of said endless belt;

a second transfer vacuum box having an open face cooperative with a downstream portion of said endless belt;

means for separately connecting said first and second transfer vacuum boxes continuously, in use, to a supply of vacuum for providing continuous availability of vacuum at the open faces of said first and second transfer vacuum boxes; and said upstream portion of said endless belt only being effective to grip the sheet being fed while this sheet is completely covering the open face of said first transfer vacuum box, and said downstream portion of said endless belt only being effective to grip the sheet being fed while this sheet is completely covering the open face of said second transfer vacuum box.

10. The apparatus of claim 9, wherein said transfer conveyor means further comprises:

a third transfer vacuum box having an open face cooperative with an extreme downstream portion of said endless belt, said extreme downstream portion being downstream of said downstream portion associated with said second transfer vacuum box;

means for continuously connecting, in use, said third transfer vacuum box to a supply of vacuum for providing continuous availability of vacuum at the open face of said third transfer vacuum box; and said extreme downstream portion of said endless belt only being effective to grip the sheet being fed while this sheet is completely covering the open face of said third transfer vacuum box.

11. The apparatus of claim 10, including vent means, connecting said third transfer vacuum box to said second vacuum transfer box, for venting said third transfer vacuum box to atmosphere via said second transfer vacuum box when the sheet being fed is completely covering the open face of said third transfer vacuum box but only partially covering the open face of said second transfer vacuum box.

12. The apparatus of claim 9, wherein said feed means is disposed essentially below said stack support surface and said transfer conveyor means is disposed above said stack support surface, said feed means engaging a lower surface of the sheet being fed and said transfer conveyor means engaging an upper surface of this sheet.

13. The apparatus of claim 12, including a guide plate spaced below said transfer conveyor means adjacent said first transfer vacuum box for diverting towards the open face of said first transfer vacuum box any warped sheet being fed by said feed means.

14. The apparatus of claim 13, including a sheet upper surface dust cleaning nozzle disposed between said control gate and an upstream end of said endless belt, and a sheet lower surface dust cleaning nozzle disposed below said endless belt downstream of said guide plate.

15. The apparatus of claim 9, wherein said intermittently driven feed means includes means for moving said feed means between an operative position and an inoperative position; and further comprising:

control means, capable of having information input thereinto, for controlling timing of movement of said feed means from the operative position to the inoperative position in dependence upon a linear dimension related to the sheets and input into said control means.

16. The apparatus of claim 15, wherein said control means comprises an input register for the inputting of said linear dimension, an electronic signal conditioning unit, and a servo drive, the input register providing a first signal to the electronic signal conditioning unit which in turn produces an output signal for operating the servo drive.

17. The apparatus of claim 16, wherein said control means includes a machine speed transducer which provides a second signal to the electronic signal conditioning unit in dependence upon a rate at which sheets are to be fed, said output signal being a function of said first and second signals.

18. Sheet feeding apparatus, comprising:

a stack support surface for supporting a stack of sheets;

at least one sheet feeding member for feeding an end sheet from the stack in a downstream direction;

lift means for moving said sheet feeding member and said stack support surface vertically relative to each other to provide an operative position of said sheet feeding member and an inoperative position thereof;

an endless belt vacuum conveyor, downstream of said stack support surface, for receiving said end sheet from said sheet feeding member and feeding this sheet further downstream, said vacuum conveyor having at least two open-faced vacuum boxes disposed in series in a downstream direction;

control means, capable of having information input thereinto, for controlling operation of said lift means including changing from said operative position to said inoperative position in dependence upon a length dimension of the sheets in the downstream direction being input into said control means; and said control means retaining said operative position until said two vacuum boxes are covered by the sheet being fed.

19. Sheet feeding apparatus, comprising:

a stack support surface for supporting a stack of sheets;

at least one sheet feeding member for feeding an end sheet from the stack in a downstream direction;

lift means for moving said sheet feeding member and said stack support surface vertically relative to each other to provide an operative position of said sheet feeding member and an inoperative position thereof;

transfer means, downstream of said stack support surface, for receiving said end sheet from said sheet feeding member and feeding this sheet further downstream;

control means, capable of having information input thereinto, for controlling operation of said lift means including changing from said operative position to said inoperative position in dependence upon a linear dimension input into said control means and related to the sheets being fed;

wherein said control means includes a register for input of said linear dimension;

wherein said lift means includes a servo motor, said register produces a signal in dependence on the input linear dimension, and said signal is employed in controlling the servo motor; and wherein said control means includes a signal conditioning unit which receives said signal, a machine speed transducer which provides a further signal to the signal conditioning unit in dependence upon a rate at which the sheets are to be fed, said signal conditioning unit producing an output signal which is a function of the signals from said register and said transducer, and said output signal controls the servo motor.

20. The apparatus of claim 19, wherein said transfer means comprises an endless transfer belt, means for driving said transfer belt at a predetermined constant speed, and at least first and second vacuum boxes disposed successively along the transfer belt for drawing the sheet being fed against the transfer belt.

21. The apparatus of claim 20, including means for continuously connecting each of said vacuum boxes to a vacuum source while sheets are being fed, and each vacuum box having an open face which has to be completely covered by the sheet being fed before that vacuum box is effective in drawing that sheet against the transfer belt.

22. The apparatus of claim 19, wherein said transfer means comprises an endless belt vacuum conveyor.

23. Sheet feeding apparatus, comprising:

a stack support surface for supporting a stack of sheets;

at least one sheet feeding member for feeding an end sheet from the stack in a downstream direction;

lift means for moving said sheet feeding member and said stack support surface vertically relative to each other to provide an operative position of said sheet feeding member and an inoperative position thereof;

transfer means, downstream of said stack support surface, for receiving said end sheet from said sheet feeding member and feeding this sheet further downstream;

control means, capable of having information input thereinto, for controlling operation of said lift means including changing from said operative position to said inoperative position in dependence upon a linear dimension input into said control means and related to the sheets being fed; and wherein said transfer means comprises an endless belt vacuum conveyor having a plurality of open-faced vacuum boxes disposed in series in a downstream direction, said linear dimension is the length dimension of the sheets in said downstream direction, and said control means retains said operative position until all said vacuum boxes are covered by the sheet being fed.

24. The apparatus of claim 23, wherein said control means includes a register for input of said linear dimension.

25. The apparatus of claim 24, wherein said lift means includes a servo motor, said register produces a signal in dependence on the input linear dimension, and said signal is employed in controlling the servo motor.

26. The apparatus of claim 23, wherein said lift means comprises a servo motor which oscillates when changing to and fro between said operative and inoperative positions.

* * * * *